US007011617B2

(12) United States Patent
Sappal et al.

(10) Patent No.: US 7,011,617 B2
(45) Date of Patent: Mar. 14, 2006

(54) FOLDER WITH GROUP JAW ADJUSTMENT

(75) Inventors: Jatinder Singh Sappal, Rochester, NH (US); Mark Anthony Wingate, New Durham, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 09/829,620

(22) Filed: Apr. 10, 2001

(65) Prior Publication Data

US 2002/0145244 A1 Oct. 10, 2002

(51) Int. Cl.
*B31F 1/10* (2006.01)

(52) U.S. Cl. ..... 493/424

(58) Field of Classification Search ..... 493/424, 493/434, 435, 442, 476, 428, 429, 440; 74/568, 74/568 R, 567, 471, 838
See application file for complete search history.

(56) References Cited

U.S. PATENT DOCUMENTS 2,128,167 A * 8/1938 Schmidt et al. ..... 493/353
3,727,909 A * 4/1973 Greiner et al. ..... 493/428
4,380,449 A * 4/1983 Michalik ..... 493/424
4,519,596 A * 5/1985 Johnson et al. ..... 270/32
5,057,064 A * 10/1991 Michalik ..... 493/8
5,096,175 A * 3/1992 Lange et al. ..... 270/49
5,417,642 A * 5/1995 Boronka et al. ..... 493/425
5,425,697 A * 6/1995 Lanvin ..... 493/426
5,429,578 A * 7/1995 Calbrix et al. ..... 493/359
5,494,270 A * 2/1996 Laubscher ..... 270/49
5,507,714 A * 4/1996 Furuta et al. ..... 493/475
5,637,072 A * 6/1997 Michaelis ..... 493/476
5,676,630 A * 10/1997 Mayr ..... 493/424
5,830,120 A * 11/1998 Rumesz et al. ..... 493/424
5,846,177 A * 12/1998 Mayr ..... 493/424
6,071,224 A * 6/2000 Lanvin et al. ..... 493/422
6,165,118 A * 12/2000 Eckert ..... 493/425
6,358,192 B1 * 3/2002 Michalik ..... 493/424
6,398,704 B1 * 6/2002 Shibuya et al. ..... 493/424
6,511,409 B1 * 1/2003 Hachiya et al. ..... 493/424
6,514,188 B1 * 2/2003 Kostiza ..... 493/424

* cited by examiner

*Primary Examiner*—Stephen F. Gerrity
*Assistant Examiner*—Paul Durand
(74) *Attorney, Agent, or Firm*—Davidson, Davidson & Kappel, LLC

(57) ABSTRACT

A folder includes a collect cylinder having at least one gripper for receiving signatures, and at least one first tucker and a jaw cylinder having at least one first jaw for interacting with the first tucker, the at least one first jaw including a stationary jaw part and a movable jaw part, the stationary jaw part and the movable jaw part being settable independently with respect to the first tucker.

8 Claims, 4 Drawing Sheets

FOLDER WITH GROUP JAW ADJUSTMENT

BACKGROUND INFORMATION

The present invention relates generally to web printing presses and more particularly to folders for web printing presses.

Web printing presses print a continuous web of material, such as paper. The continuous web then is cut in a cutting unit of a folder so as to form signatures which can then be folded or output.

U.S. Pat. No. 5,057,064 purports to discloses a folding jaw cylinder that has at least one set of movable jaws and a cooperating set of stationary folding jaws. The adjusting spindle is, with its left-hand and right-hand threaded ends, in screw contact with adjusting supports. The adjusting supports are each supported in radically arranged, axially extending holes in the supporting disks. Due to the arrangement of the adjusting supports in the long holes, compensating movements can be carried out which are required to convert the traditional movement created by adjusting shaft into a rotational movement of supporting disks. This rotational movement of these first and second pairs of supporting disks, respectively will, in turn, effect relative movement of the movable jaw set and the fixed jaw set toward and away from each other. This relative movement of these two jaw sets will vary the spacing distance "a" so that folded products formed from paper webs or ribbons of different thicknesses may be accommodated.

The stationary and the folding jaws thus are set a distance apart by the same mechanism.

U.S. Pat. No. 5,096,175 purports to disclose an adjustment system for concurrent, symmetrical adjustment of the mutual position of the first and second jaws of a folding jaw pair of a folding jaw cylinder. The folding jaw cylinder has a shaft and folding jaw carrier bodies, which can rock or swivel or pivot about the folding jaw cylinder shaft. Upon turning hand wheel, spindle and the holder sleeve are rotated and axially moved. These adjustment movements, taken together, provide for simultaneous scissor or pincer-like adjustment position of the respective folding jaws, so that readjustment of the position of a folding blade in the folding blade cylinder is not necessary.

SUMMARY OF THE INVENTION

An object of the present invention is to provide for a folder and method for gripping and transporting printed products whereby damage to the printed products may be reduced. An additional or alternative object of the present invention is to provide for a combination folder with easy adjustment for varying printed product sizes. Another object of the present invention is to decouple a fixed jaw and movable jaw during a group jaw adjustment.

The present invention provides a folder including a collect cylinder having at least one gripper for receiving signatures and at least one first tucker, and a jaw cylinder having at least one first jaw for interacting with the first tucker. The first jaw includes a stationary jaw part and a movable jaw part. Each of the stationary jaw part and the movable jaw part are settable independently with respect to the first tucker.

Thus, the stationary jaw part is movable during a first setting operation with respect to the first tucker so as to define a first distance, and the movable jaw is settable independent of the first setting operation so as to define a second distance between the movable jaw part and the first tucker during a tuck.

By providing for independent setting of the stationary and movable jaw parts, variable and larger signature thicknesses can be accommodated more easily by the jaw. On-the-fly changes also are possible.

In a first embodiment of the present invention, the stationary and movable jaw parts are on the same arm of a jaw spider. The jaw spider moves with respect to the tucker spider through an adjusting center or gear, thus moving both the stationary and movable jaw parts in a similar direction with respect to the first tucker. The adjusting centers permit tuckers to remain grounded while the jaw parts move. The first distance between the stationary jaw part and the first tucker thus can be set. The adjusting centers provide the advantage of allowing jaw changes to be made without having to manually re-adjust the device when the machine is stopped.

A cam with a sloped activation surface activates the movable jaw part for grasping a fold. The second distance between the movable jaw part and the first tucker at the tuck can be set by altering the position of a sloped activation surface of the cam, so that the movable jaw part has a settable gap and closes at the right moment.

In a second embodiment, the stationary jaw parts are located on a stationary jaw spider, the movable jaw parts are located on a flex jaw spider and the first tuckers located on a tucker spider. The stationary jaw spider and the flex jaw spider are connected via an adjusting center or gear. During a group jaw adjust, the flex jaw spider and the tucker spider remain grounded, and the stationary jaw spider moves, thus altering the distance between the stationary jaw parts and the tucking blade/movable jaw parts.

The distance between the tucking blade and the movable jaw parts during a tuck can be set by moving the actuating cam as in the first embodiment.

Preferably, a third adjusting gear set and a brake effectuate a mode change, for example from a delta fold to a double parallel fold, by adjusting the first jaw set with respect to a second jaw set on the jaw cylinder. Hence, the third adjusting gear set provides the advantage of allowing mode changes to be made without having to manually re-configure the device.

The present invention also includes a method for adjusting a printing press having the steps of adjusting a stationary jaw part of a first jaw with respect to a first tucker of a collect cylinder; and independently adjusting the distance between a movable jaw part and the first tucker for a tucking operation.

In a first embodiment, the adjusting of the stationary jaw part step also causes the movable jaw part to move with respect to the first tucker. In a second embodiment, during the adjusting of the stationary jaw part step, the movable jaw remains fixed.

The method may further include making a second adjustment by adjusting a second fixed jaw part of a second jaw with respect to a second tucker of a delta/double parallel cylinder. A mode change may be effectuated by adjusting the second jaw set with respect to the first jaw set.

The present invention also provides a folder comprising a collect cylinder having a first tucker set, a jaw cylinder having a first jaw set for interacting with the first tucker set, the first jaw set having a stationary jaw part settable with respect to the first tucker set using a first adjusting mechanism, and having a movable jaw part independently adjustable with respect to the first tucker by adjusting an actuating cam of the movable jaw part.

The folder preferably is a combination folder in which the jaw cylinder may have a second jaw set with a second jaw stationary part settable with respect to another tucker and a second jaw movable part settable independently with respect to the other tucker by adjusting another cam.

BRIEF DESCRIPTION OF THE DRAWINGS

The present invention is elucidated in the following on the basis of the drawing, in which.

DETAILED DESCRIPTION OF THE PREFERRED EMBODIMENTS

Figure 1:
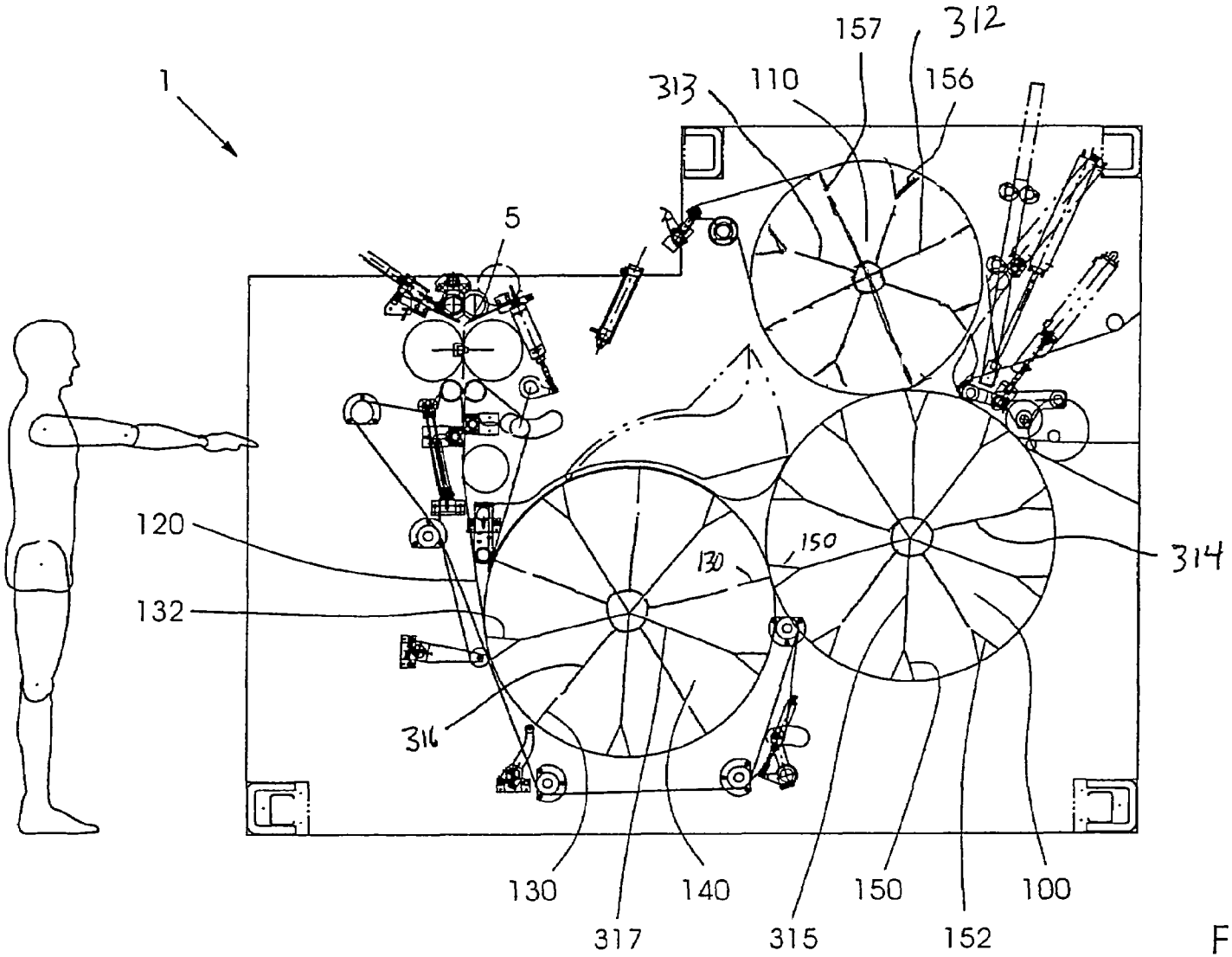
FIG. 1 shows a schematic view of a combination folder of the present invention.

FIG. 1 shows a schematic view the work side of a combination folder 1 with a collect cylinder 140, a jaw cylinder 100 and a double parallel or delta fold cylinder 110. A signature 120 is cut from a web of material 5 and gripped by one of a plurality of grippers 132 of collect cylinder 140. Grippers 132 are held on a spider 317, which may have for example five arms, as shown in schematically in FIGS. 3 and 4. A plurality of tuckers 130, located for example halfway between consecutive grippers 132, are provided for tucking the signature 120 into a first set of jaws 150 of jaw cylinder 100. Tuckers 130 are carried on a spider 316 as shown schematically in FIGS. 3 and 4, and are cam-activated.

Figure 3:
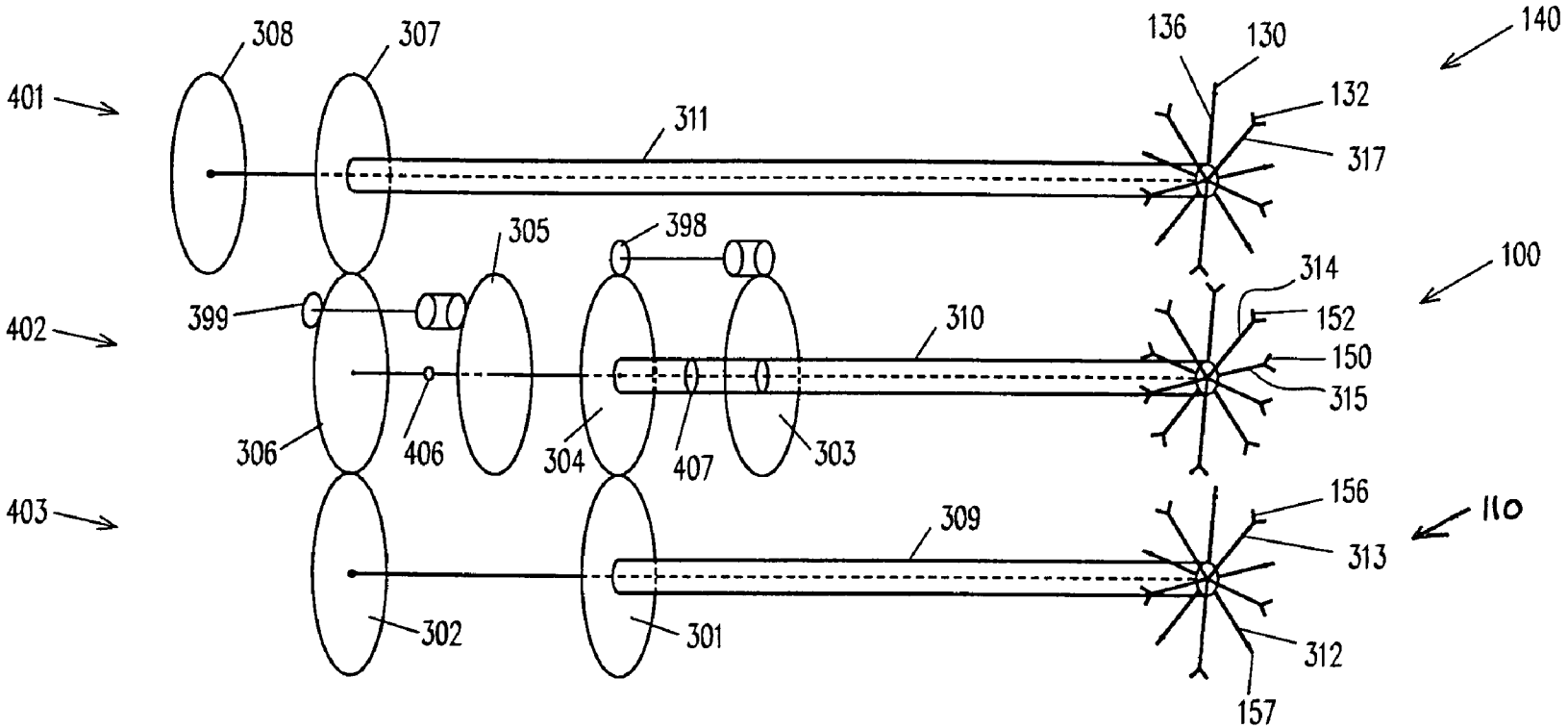
FIG. 3 illustrates a first gearing arrangement for the combination folder of FIG. 1.

In a first embodiment, the first set of jaws 150 are also held on a spider 315, shown schematically in FIG. 3. A second set of jaws 152, also provided on jaw cylinder 100, is carried on a different spider 314, as shown schematically in FIG. 3.

Figure 2B:
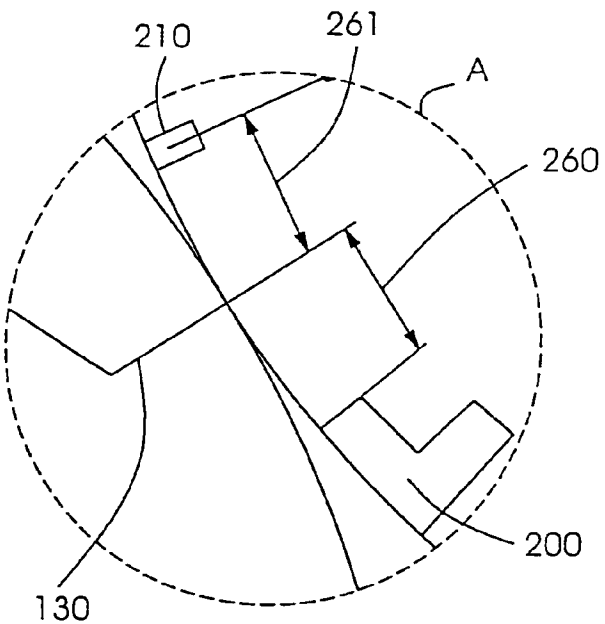
FIG. 2*b* is an expanded view of the area A in FIG. 2*a;*
Figure 2A:
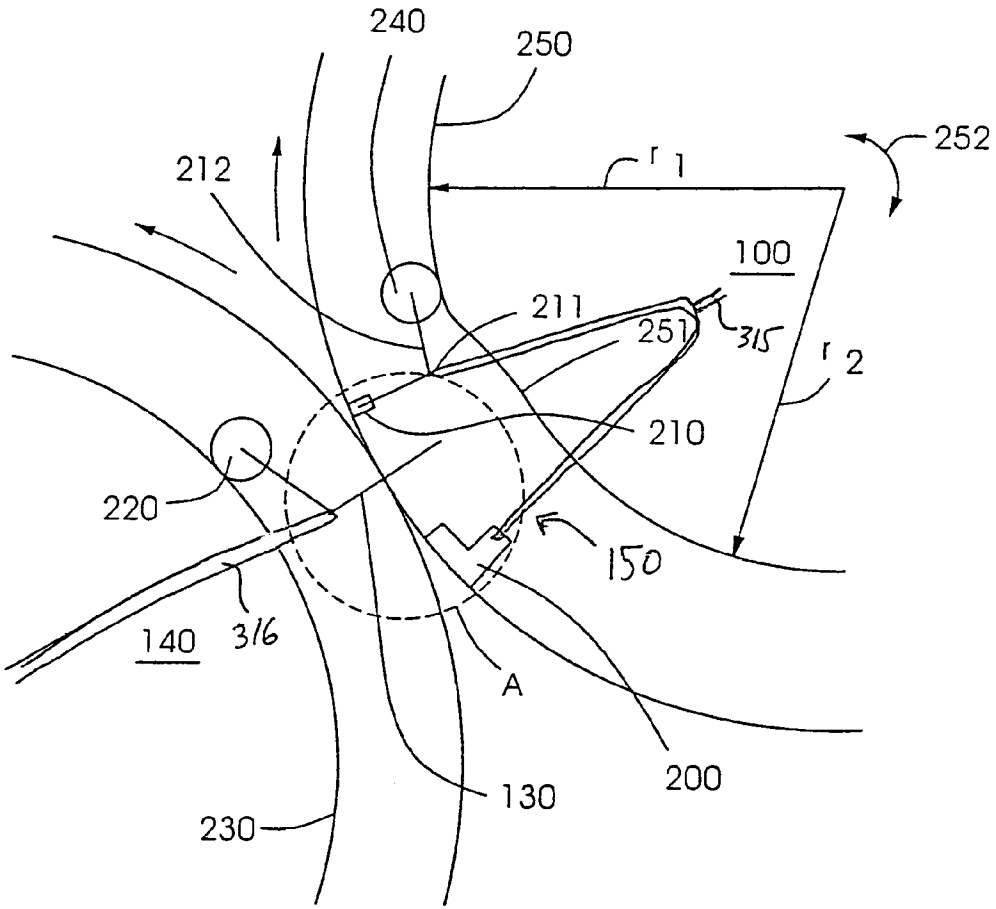
FIG. 2*a* depicts in greater detail the fixed jaw and the movable jaw arrangement of the first (or second) jaw set of the jaw cylinder in relation to one of the tuckers.

As shown in FIGS. 2*a* and 2*b,* each of the jaws of jaws 150 and 152 of FIG. 1 includes a stationary part 200 fixedly attached to a respective spider arm and a movable jaw part 210 supported on an arm 212 pivotably supported on a pivot 211. A cam follower 240 is at the other end of arm 212. In the first embodiment of FIG. 3, the stationary jaw part 200 and the movable jaw part 210 of jaws 150 are on a common spider arm of spider 315, as shown in FIG. 2*a* as well. In a second embodiment of FIG. 4, the stationary jaw part 200 of jaw 150 is on a jaw spider arm of jaw spider 415, while the movable jaw part 210 is on a flex jaw spider arm 429. In either embodiment, the stationary jaw part 200 has a settable distance 260 from tucker 130 which may be independent from a distance 261 present between tucker 130 and movable jaw part 210 when the tucker 130 tucks a signature.

During operation of folder 1, when a tabloid product is required, the collect cylinder 140 tucks the signature 120 with one of the tuckers 130, supported on spider 316 as shown in FIGS. 1 and 2*a,* into one of first jaw set 150, each of which have the fixed jaw part 200 and a movable jaw part 210 arrangement (See FIGS. 2*a* and 2*b*.). Tucker 130 is activated by a cam follower 220 interacting with a cam 230.

The fixed jaw 200 is fixed with respect to the tucker 130 for a certain product size, and the movable jaw 210 opens and shuts depending on the interaction of cam follower 240 with a cam 250 as shown in FIG. 2*a*. Cam 250 has a first radius r2 at which the movable jaw 212 is wide open and a radius r1 at which the movable jaw grasps a signature, r1 being greater than r2. A sloped surface 251 has a radius varying between r1 and r2. The sloped surface 251 thus defines the location of movable jaw 210 when the tuck of tucker 130 occurs. The cam 250 can be rotated as shown by arrows 252, for example by a worm wheel, so as to vary the location of movable jaw 210 when tucker 130 tucks the signature, thus defining distance 261 of FIG. 2*b*. The cam rotation thus is independent of the setting of the distance 260, which will be described with respect to FIGS. 3 and 4. The distances 260 and 261 thus can be set independently, for example for a proper signature thickness.

During a tabloid fold of a signature, the signature 120 passes directly from the collect cylinder 140 to jaw cylinder 100 with a single fold imparted by tuckers 130 and jaws 150, and then passes downstream, e.g., on to a delivery device or a quarter folder.

When a delta or double parallel folded signature 120 is required, the collect cylinder 140 tucks the signature 120 into one of the first jaw sets 150 of the jaw cylinder 100. The jaw cylinder 100 then transfers the folded edge of signature 120 to a gripper 156 (FIG. 1) of the double parallel/delta fold cylinder 110, which then uses a tucker 157 to provide a second fold to the signature 120. Tucker 157 tucks the second fold into one of a plurality of second jaw sets 152. The second jaw sets 152 also have the fixed jaw 200 and the movable jaw 210 arrangement shown in FIGS. 2*a* and 2*b*. The signature 120, with the second fold, then passes downstream, e.g., on to the delivery or the quarter folder.

More details of a combination folder, such as the spiders, are disclosed for example in commonly-owned U.S. patent application Ser. No. 09/795,075, filed Feb. 23, 2001, published as U.S. Patent Publication No. 2002/0119877 which is hereby incorporated-by-reference herein.

The setting of distance 260 in FIG. 2B will be described for the embodiments of FIGS. 3 and 4.

FIG. 3 illustrates schematically a gearing arrangement for moving the fixed jaws 200 on the first and second jaw sets 150, 152, with gearing 401 for the collect cylinder 140, gearing 402 for the jaw cylinder 100, and gearing 403 for the delta cylinder 110.

A gripper spider 317 on work side 405 holds collect cylinder grippers 132 and is driven on the gear side 404 by a gripper gear 308. Collect cylinder tuckers 130 are supported on a tucker spider 316, and driven by a tucker gear 307, which connects to the tucker spider by a hollow journal 311. A shaft passing through the hollow journal 311 connects gripper gear 308 and gripper spider 317. The gripper gear 308 and tucker gear 307 can be grounded, so as not to move when a group jaw adjust occurs. The gears 308, 307 can be driven by different motors, or by a common motor and be connected by a gear which permits relative movement for altering the fold location or lap.

Gear 307 is geared to a first jaw intermediate gear 306, which is connected via a first adjusting center 399 to a first jaw gear 305, as also shown in FIG. 5. The gears 306 and 305 rotate together, except when first adjusting center 399 moves to perform a group jaw adjust. A bearing 406 is provided to permit the relative movement. First adjusting center 399 preferably is a compound idler gear center using helical gears with opposite hands (the helix on the gear teeth causes the mating gear or other gears in mesh to rotate like a screw thread), which causes gear 305 to change phase with respect to gear 306. Intermediate gear 306 also is geared to a delta/double parallel gripper gear 302, which drives a second gripper spider 313 holding second grippers 156.

Gear 308 thus constitutes a first drive train controlling acceptance of the signatures, while gears 307, 306, 305 and 302 constitute a second drive train controlling the first fold.

The group jaw adjust for the first fold occurs as follows: Gears 307 and 306 remain grounded, so that tucker spider 316 and tuckers 130 are also grounded. Adjusting center 399 thus moves axially to move gear 305 relative to grounded gear 306, thus moving spider 315 and jaws 150, including stationary part 200 relative to tuckers 130 to set distance 260 (FIG. 2B). Independently, the cam 250 can be rotated to set distance 261.

As shown in FIG. 3, a third drive train for controlling the second parallel fold includes double parallel/delta tucker gear 301 which drives, using a hollow journal, the delta tucker spider 312 with tuckers 157. Delta tucker gear 301 is geared to a second jaw intermediate gear 304 which connects to a second adjusting center 398, as shown also in FIG. 6. Second adjusting center 398 can be a compound idler gear center using helical gears with opposite hands, and drives a second jaw gear 303, which in turn drives second jaw spider 314 through hollow journal 310. Second jaw intermediate gear 304 grounds to the delta/double parallel cylinder tucker gear 301. The second jaw gear 303 may move and alter phase with respect to gear 304 due to bearings 407 and the actuation of second adjusting center 398.

Second jaw adjusting center 398 thus can be used to set the distance between a stationary jaw part of jaws 152 and tuckers 157. An activating cam for movable jaw parts of jaws 152 can be used to independently set the distance at the tuck between the movable jaw part of jaws 152 and tuckers 157.

Figure 4:
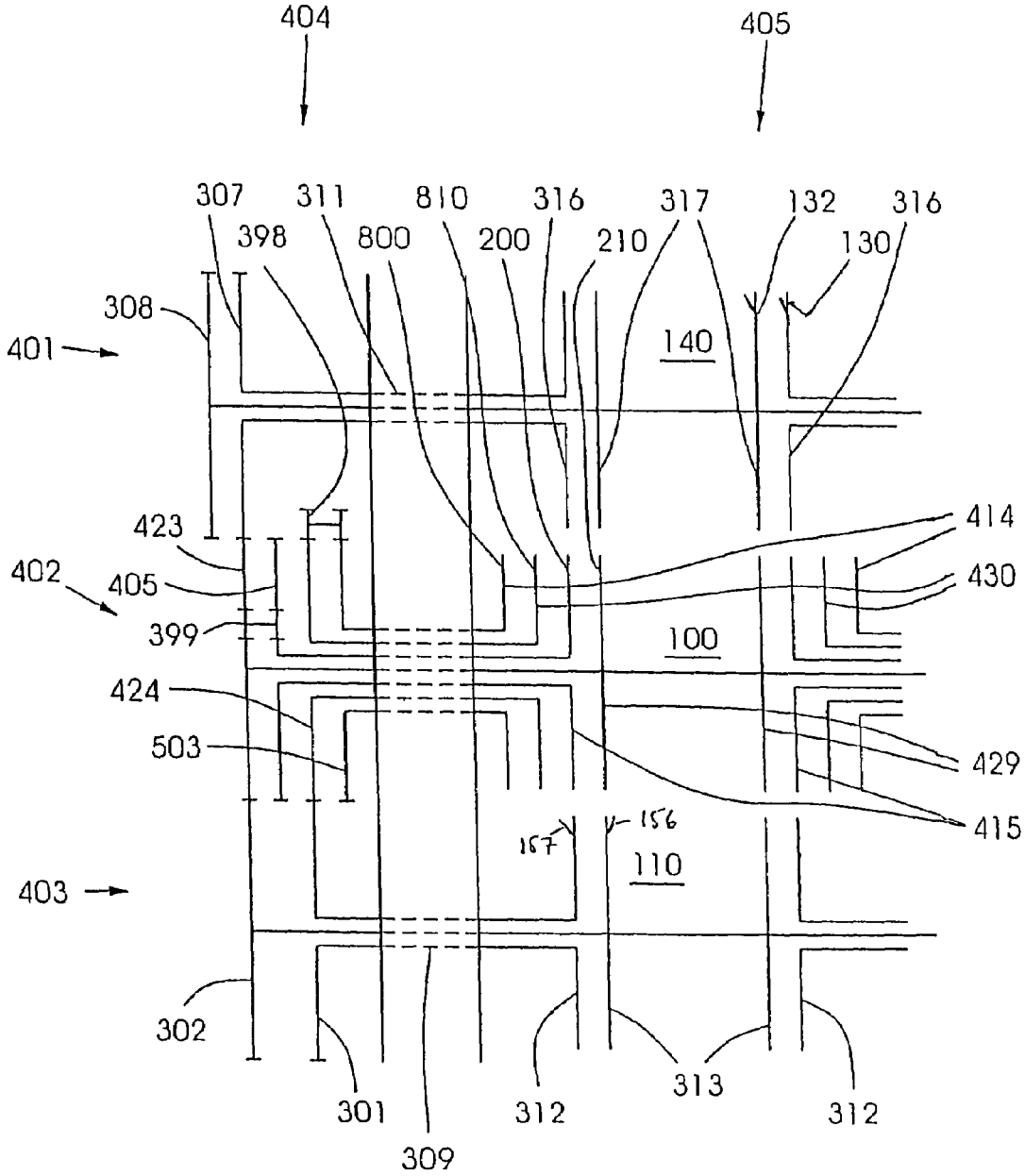
FIG. 4 shows an alternate gearing arrangement for the combination folder of FIG. 1.

FIG. 4 shows an alternate embodiment in which the collect cylinder 140 and delta cylinder 100 parts are similar to FIG. 3. However, the jaw cylinder 100 has separate spiders 415, 429 for each of the stationary jaw parts 200 and the movable jaw parts 210, respectively. Stationary jaw parts 800 of second jaws 152 are supported on a second jaw spider 414 and stationary jaw parts 810 of second jaws 152 are supported on a second jaw flex spider 430. It should be understood that stationary jaw parts 800 and movable jaw parts 810 function similarly to parts 200 and 210, respectively. First jaw flex spider 429 is connected via a shaft to a first jaw flex gear 423, geared to gear 307 of collect cylinder 140 and tuckers 130. Tuckers 130 and movable first jaw parts 210 thus are geared together. First adjusting center 399 connects gear 423 to first jaw intermediate gear 405, which is connected to first jaw stationary part spider 415. Thus, when gears 307 and 423 are grounded, first adjusting center 399 can adjust the distance between tucker 130 and stationary first jaw part 200 so as to set distance 260 (FIG. 2B). In the FIG. 4 embodiment, the setting of the distance 260 does not change the distance 261, which as in the FIG. 3 embodiment remains in any event independently settable by rotating cam 250.

Second jaw stationary part 800 is supported on a spider 414 connected to gear 503, and movable part 810 on a spider 430 connected to gear 424. While gear 424 and gear 301, and thus tucker 157 and movable part 810 remain grounded, second adjusting center 398 can be moved axially to alter the rotational phase between gears 424 and 403, thus moving second jaw stationary part 800 with respect to tucker 157. The location of movable part 810 at the tuck can be altered by rotating its actuating cam.

Thus both the first and second jaws 150, 152 in both embodiments have stationary and movable jaw parts independently settable with respect to the respective tucker.

In order for a mode change (e.g., double parallel to delta)to occur, a brake can be engaged to ground the first jaw gears, thus permitting the second jaw gears to rotate, resulting in the mode change.

What is claimed is:

1. A method for adjusting a printing press comprising the steps of:

adjusting a stationary jaw part of a first jaw with respect to a first tucker of a collect cylinder; and independently adjusting the distance between a movable jaw part and the first tucker for a tucking operation;

wherein the adjusting of the stationary jaw part step also causes the movable jaw part to move with respect to the first tucker.

2. The method as recited in claim 1 further comprising adjusting a second fixed jaw part of a second jaw with respect to a second tucker of a delta/double parallel cylinder.

3. A method for adjusting a printing press comprising the steps of:

adjusting a stationary jaw part of a first jaw with respect to a first tucker of a collect cylinder;

independently adjusting the distance between a movable jaw part and the first tucker for a tucking operation; and adjusting a second fixed jaw part of a second jaw with respect to a second tucker of a delta/double parallel cylinder.

4. A folder comprising:

a collect cylinder having at least one gripper for receiving signatures, and at least one first tucker; and a jaw cylinder having at least one first jaw for interacting with the first tucker, the at least one first jaw including a stationary jaw part and a movable jaw part, the stationary jaw part and the movable jaw part being settable independently with respect to the first tucker;

wherein the stationary jaw part is movable during a first setting operation with respect to the first tucker so as to define a first distance, and the movable jaw part is settable independently of the first setting operation so as to define a second distance between the movable jaw part and the first tucker during a tuck.

5. The folder as recited in claim 4 wherein the jaw cylinder further comprises a jaw spider, the stationary and movable jaw parts being commonly supported on the jaw spider.

6. The folder as recited in claim 4 further comprising an adjusting center or gear for moving the tucker with respect to the stationary jaw parts.

7. The folder as recited in claim 6 further comprising a cam rotatable for setting the movable jaw part with respect to the first tucker.

8. The folder as recited in claim 4 further comprising a cam rotatable for setting the movable jaw part with respect to the first tucker.

* * * * *